United States Patent [19]

Collins et al.

[11] 4,412,844

[45] Nov. 1, 1983

[54] STABLE OIL DISPERSIBLE MAGNESIUM HYDROXIDE SLURRIES

[75] Inventors: John H. Collins, Bloomingdale; Mei-Jan L. Lin, Naperville; George T. Kekish, Chicago, all of Ill.

[73] Assignee: Nalco Chemical Company, Oak Brook, Ill.

[21] Appl. No.: 277,371

[22] Filed: Jun. 25, 1981

Related U.S. Application Data

[63] Continuation of Ser. No. 50,376, Jun. 20, 1979, abandoned.

[51] Int. Cl.[3] ..... C10M 1/06; C10M 1/10; C10L 1/12

[52] U.S. Cl. ..... 44/51; 44/DIG. 3; 252/49.5; 252/25; 252/49.7

[58] Field of Search ..... 252/25, 49.5, 49.7; 44/51, DIG. 3

[56] References Cited

U.S. PATENT DOCUMENTS 3,067,018 12/1962 Voorhees ..... 44/51

3,540,866 11/1970 Miller ..... 44/51

4,119,547 10/1978 Nachlman et al. ..... 252/25

*Primary Examiner*—Jacqueline V. Howard

*Attorney, Agent, or Firm*—John G. Premo; Robert A. Miller

[57] ABSTRACT

Stable, oil dispersible, aqueous dispersions of magnesium hydroxide useful as deposit control additives for residual fuels can be prepared. These slurries, of magnesium hydroxide contain generally:

(A) 20–70% $Mg(OH)_2$ having a particle size of 50 to 1.0 micron;

(B) 79–29% water;

(C) 1.0–8.0% of a water-in-oil emulsifying agent having an HLB value of from 2 to 11;

(D) 0.1–6% of a water soluble water-in-oil emulsifying agent having an HLB value of from 10 to 40;

Said dispersion having a Brookfield Viscosity of from 100–5000 cps. (#3 spindle at 12 rpm, 75° F.)

2 Claims, No Drawings

STABLE OIL DISPERSIBLE MAGNESIUM HYDROXIDE SLURRIES

This application is a continuation of copending application Ser. No. 050,376 filed June 20, 1979, now abandoned.

INTRODUCTION

Magnesium containing corrosion inhibitors for the inhibition of fireside deposits in boilers and gas turbine units are well-known. These additives, generally being prepared as an oil soluble salt of magnesium which can be fed and dispersed into residual and other type of hydrocarbon fuel oils for the control and inhibition of vanadium corrosion have met with some commercial success in the past.

While these oil soluble compounds have been utilized, a serious factor affecting their commercial performance has been the cost and methods of preparation. Magnesium is a naturally occurring element found in sea water and brines which are present in great abundance. While the end product of combusting the magnesium compound in a residual fuel oil or the like is magnesium oxide and it is believed that magnesium oxide is the active species as a corrosion inhibitor, the problems connected with the utilization of magnesium oxide, such as uniformly dispersing the material into the hydrocarbon fuel have prevented commercial use. With more and more emphasis being placed on obtaining alternate forms of energy and the fact that high vanadium content residual fuels are available in large quantities, it would be an advantage to the art to provide a stable and economical method for introducing magnesium into these fuels.

It has been discovered that a stable aqueous dispersion of magnesium hydroxide can be prepared and that these materials can be readily and uniformly dispersed into hydrocarbon fuel oils to provide magnesium, thus inhibiting vanadium and sulfuric acid corrosion, as well as rendering slag more friable and decrease the rate of slag build-up. The stable aqueous dispersions of magnesium hydroxide which are a part of the instant invention contain relatively high percentages of magnesium hydroxide, are storage stable over a long period of time, and are readily dispersible into residual oils to provide an intimate admixture of the magnesium compound in the residual fuel oil.

It is, therefore, an object of this invention to provide to the art a magnesium hydroxide slurry which is storage stable, dispersible into hydrocarbon fuels, and which can be prepared economically.

A further object of this invention is to provide to the art a stable aqueous dispersion of finely divided particles of magnesium hydroxide which when added to hydrocarbon fuels is dispersible therein and which acts to prevent vanadium corrosion.

Further objections will appear hereinafter.

THE INVENTION

In its broad concept, this invention deals with a stable, oil dispersible, aqueous dispersible of finely divided particles of magnesium hydroxide useful for the prevention of vanadium corrosion in liquid hydrocarbon fuels. The composition of this invention broadly comprises the following ingredients in percentages by weight:

(A) 20–70% $Mg(OH)_2$ having a particle size of 50 to 1.0 micron;

(B) 79–29% water;

(C) 1.0–8.0% of a water-in-oil emulsifying agent having an HLB value of from 2 to 11;

(D) 0.1–6% of a water soluble water-in-oil emulsifying agent having an HLB value of from 10 to 40;

Preferably, the composition of this invention comprises the ingredients in the following percentages by weight:

(A) 30–60%
(B) 70–35%
(C) 1.0–7%
(D) 1.0–4%

The magnesium hydroxide employed in this invention is in the form of an aqueous slurry. A suitable material as an example is available from the Dow Chemical Company under the trade designation MHT-60. The specifications of this material as disclosed in the Dow Chemical Company "Magnesium Hydroxide Handbook" is found in Table I.

TABLE I

| | |
|---|---|
| Magnesium Hydroxide MHT-60 | |
| Magnesium hydroxide, minimum % | 55 |
| Magnesium oxide equivalent, minimum % | 38 |
| Chlorides (as Cl), maximum % | 0.25 |
| Bulk density | |
| lb/gal. | 12.75 |
| lb/cu ft. | 95.5 |
| Specific gravity, 60% slurry | 1.53 |
| pH range, 20% solids basis | 10.5–10.7 |
| % Total solids | 55.0–60.0 |
| % Water | 45.0–40.0 |
| Viscosity, Poises, Stormer viscometer, 60% slurry | 4.5–35 |
| Particle size, Andreason sedimentation pipet | |
| 20–30 micron range | 5% |
| 10–20 micron range | 15% |
| 5–10 micron range | 35% |
| 2–5 micron range | 25% |
| <2 microns | 20% |
| Grit content, slurry basis (% dry grit on 325 mesh sieve) | 0.1–0.2 |
| Brightness, Bausch and Lomb Spectronic 20 meter, dry basis | 91–94 |

While it is noted that the particle size of this material is predominantly in the 5–10 micron range, processing this material according to steps disclosed later in this specification produces a material having a particle size in the less than 2 micron size range.

It is to be noted that the above described magnesium hydroxide slurry is only a preferred embodiment of this invention and other magnesium hydroxide slurries containing from 20–70% and preferably 30–60% by weight magnesium hydroxide can be employed. The particle size of the magnesium hydroxide slurry which is employed in the instant invention can range from 50 down to less than 2 microns. Preferably, the material should be a particle size in the range of about 30–2 microns. The magnesium hydroxide slurry thus described is further processed into the unique material of this invention.

PREPARATION OF THE SLURRY

While the above described magnesium hydroxide slurries are stable for limited periods of time, more storage stability is generally required to insure accurate feeding of this type of material to a hydrocarbon fuel mixture. Thus, other additives must be utilized to insure the stability of this material and to prevent it from settling out during prolonged periods of time. We have found that certain water-in-oil surfactants generally having a hydrophile-lipophile balance (HLB) in the range of 2–11 will act to stabilize the magnesium hydroxide slurries and thus prevent them from settling. The preferred HLB value of the materials employed should range from 4–10. Suitable materials useful for the stabilization and this part of this invention include Witcamide 5138 available from the Witco Chemical Company which is described as an alkanolamine fatty acid condensate; Surco 5024, available from the Surfact-Co which is described as a mixed fatty acid diethanolamide condensate; and Monamine 853 available from Mona Industries, Inc., described as modified alkanolamide. Other materials which should find application in this section of the instant invention should be oil-soluble, water-dispersible non-ionic fatty alkyl alkanolamine and alkanolamide materials. Amphoteric oil-soluble water-dispersible imidazoline type materials may also be used. While the above materials are exemplary in the manufacture of the stable magnesium hydroxide slurries of this invention it is suspected that other oil-soluble non-ionic slurries will produce stable slurries and thus this invention is not meant to be limited by the above commercial materials. The surfactant will generally be used at a level of from 1–8% by weight of the slurry and most preferably at a level of from 2–5% by weight of the slurry.

After this surfactant has been added to the magnesium hydroxide dispersion, the dispersion is mixed well. At this point, and optionally, a second water-in-oil emulsifying agent having a HLB value of greater than 6 and preferably in the range of 10–40 is added to the dispersion. Most preferably the HLB value of the emulsifier will range from 20–40. The addition of the second surfactant optimizes stability by minimizing solid settling and water-split-out after long storage periods. Utilization of the second surfactant enables slurries to be maintained homogeneously for periods of generally more than 4 months.

Surfactants which are useful as the "second surfactant" include petroleum sulfonates, sulfated vegetable oils, complex phosphate esters, sorbitan mono fatty esters, and alkyl phenoxy polyethylene oxy ethanol. The second surfactant employed must be water soluble or at least dispersible in water and may be anionic, non-ionic, cationic or polymeric. Preferred materials have surface active groups such as amide amine, or ammonium functionality. Especially effective are amine and ammonium salts of alkyl or aryl sulfates and sulfonates. Also useful are polymeric materials such as acrylic acid-acrylate copolymers. While dispersible solid thickeners may be utilized as additives, materials such as Kelzan enhance stability but tend to harm the products ultimate dispersibility in the hydrocarbon feature.

While water has been described as a part of the magnesium hydroxide slurry which is the first component of the composition, it should be pointed out that it is also possible to start with a magnesium hydroxide powder and then disperse this material into water. As such, the composition of this invention should contain 29–79% weight water and more preferably 70–35% by weight water. Most preferably a water level of approximately 45–55% is employed.

As described earlier, the composition of this invention is prepared by merely mixing together the above mentioned ingredients utilizing satisfactory mixing. After mixing, the resultant composition may be stored in any type of suitable containers for extended periods of time without the need for reagitation.

Due to the presence of the "first" emulsifier the magnesium hydroxide slurries prepared according to this invention are readily dispersible into hydrocarbon fuels. The slurries may be added to a fuel line which is then mixed by either a static mixer or centrifugal pump. Alternatively, the slurry may be added to the fuel by utilizing a chemical injector in the fuel line. Of course, other methods have for the introduction of the oil dispersible magnesium hydroxide slurry will be apparent to those skilled in the art.

The slurry is generally added to the fuel oil based upon the amount of vanadium present in the oil. Dosages can be readily calculated in that the magnesium should be added at a level in that magnesium should be present (as magnesium oxide) at a level of from 1–3.0 moles per each mole of vanadium (metallic) present in the fuel oil. Preferably from 1 to 6 moles calculated as magnesium oxide should be present in the fuel oil per each mole of vanadium (as V). Most preferably from 1.5 to 3 moles of magnesium should be added per each mole of vanadium present. The additive of this invention is generally added to the fuel at a level of from 1–6 pints per 1000 gallons of fuel oil, but may vary considerably depending on the amount of vanadium present in the fuel oil, and the Mg concentration of the slurry.

EXAMPLE 1

Preparation of Magnesium Hydroxide Slurry

95 Parts by weight of a magnesium hydroxide slurry containing 55% by weight magnesium hydroxide available from the Dow Chemical Company under the designation 60D Technical is mixed in a suitable container for 10 minutes. After this period of time 3 parts by weight of Witcamide 5138 is added to the magnesium hydroxide slurry with continued mixing. After mixing for 10 minutes 2.0 parts by weight of Stepanol DEA a diethanolamine lauryl sulfate available from the Stepan Chemical Company is added. After an additional 10 minute period of time mixing the material is removed from the mixing vessel and placed in a storage tank. The resultant material had a pH of 9.6 and is completely pourable at as low a temperature as 32° F. The material in contrast to the starting magnesium hydroxide slurry had excellent dispersibility in fuel oil and was much more stable. The raw material employed after standing for 10 days yielded 20% water split-out, 35% hard sediment, and 45% slurry. The material prepared according to the instant invention was still in complete suspension at the end of this time.

EXAMPLE 2

The magnesium hydroxide slurry formed in Example 1 would be utilized to control vanadium corrosion in a utility boiler. The slurry of Example 1 would be added to residual fuel oil containing vanadium which was being fed to utility boiler. The slurry was fed at a rate so as to provide 3 moles of magnesium (as MgO) for each mole of vanadium pentoxide. In the fireside of the boiler itself the magnesium compound would react with the vanadium in the fuel oil to form the species $3MgO.V_2O_5$ which would be collected in the particulate recovery system found in the boiler. By the use of this program, deposits of vanadium in the fireside of the boiler would be substantially decreased allowing increased heat transfer and thus more efficient operation of the boiler.

Having thus described our invention, we claim:

1. A stable, oil-dispersible, aqueous dispersion of magnesium hydroxide useful as a vanadium corrosion additive for liquid hydrocarbon fuels comprising in percentages by weight:

(a) 20–70% magnesium hydroxide having particle size from 1.0–50 microns;

(b) 29–79% water;

(c) 1.0–8.0% of a water-dispersible, oil-soluble, water-in-oil emulsifying agent having an HLB value of from 4–10;

(d) 0.1–6% of a water-soluble, oil-dispersible emulsifying agent having an HLB of from 20–40, said water-soluble oil-dispersible emulsifying agent being characterized as having a surface active functional group from the group consisting of amide, amine, or ammonium; said dispersion having a Brookfield viscosity of 100–5000 cps utilizing a #3 spindle at 12 rpm at 75° F., said dispersion further being characterized as being readily dispersible into a liquid hydrocarbon fuel.

2. The stable, oil-dispersible aqueous dispersion of magnesium hydroxide of claim 1 wherein the percentates by weight of components (a)–(d) are as follows:

(a) 30–60%

(b) 70–35%

(c) 1.0–7%

(d) 1.0–4%.

* * * * *